United States Patent [19]

Ohashi et al.

[11] 4,125,356

[45] Nov. 14, 1978

[54] SAFETY EQUIPMENT FOR GAS BURNER

[75] Inventors: Tokuyoshi Ohashi, Nabari; Akira Matuda, Nara; Hiroshi Horii, Kashiwara, all of Japan

[73] Assignee: Matsushita Electric Industrial Co., Ltd., Osaka, Japan

[21] Appl. No.: 784,707

[22] Filed: Apr. 5, 1977

[30] Foreign Application Priority Data

Apr. 15, 1976 [JP] Japan ..... 51-43120

[51] Int. Cl.[2] ..... F23H 5/24

[52] U.S. Cl. ..... 431/76; 431/80

[58] Field of Search ..... 431/76, 80, 75, 78; 200/61.03

[56] References Cited

U.S. PATENT DOCUMENTS 4,032,286 6/1977 Kobayashi et al. ..... 431/76

FOREIGN PATENT DOCUMENTS 2,510,719 12/1975 Fed. Rep. of Germany ..... 431/76

*Primary Examiner*—Edward G. Favors

*Attorney, Agent, or Firm*—Stevens, Davis, Miller & Mosher

[57] ABSTRACT

A safety equipment for a gas burner is disclosed wherein a combustion sensor comprising an oxygen concentration cell having porous electrodes disposed on both sides of a sintered body of ion conductive solid electrolyte, is provided, so that incomplete combustion and extinction of the burner are detected by a change in e.m.f. of the sensor and a change in resistance of the sensor. The detected signal is used to block the feed of fuel to the burner in order to prevent CO gas poisoning and explosion.

7 Claims, 8 Drawing Figures

SAFETY EQUIPMENT FOR GAS BURNER

The present invention relates to a safety equipment for a gas burner in which a single combustion sensor detects incomplete combustion and extinction of a gas burner for blocking supply path of fuel gas.

In domestic gas equipments, one of the most common safety equipments is the one which uses an electromagnetic safety valve operated by an output of a thermocouple. In this type of safety equipment, the thermocouple is heated by the combustion of a burner to generate a thermal e.m.f. which, in turn, energizes the electromagnetic safety valve to maintain it in an open position. According to this system, if the burner extinguishes by deformation of a gas hose or by wind, the thermal e.m.f. of the thermocouple is reduced to zero and the electromagnetic safety valve is closed. Thus, poisoning by the flow of gas or explosion can be prevented.

However, the above system does not work fully well for the incomplete combustion of the burner.

Safety feature for the incomplete combustion might be provided if a flame plate of the burner is modified such that combustion flame is lifted when the amount of oxygen in fuel-air mixture becomes lower with the result that the thermocouple is positioned outside a combustion flame forming region. However, the oxygen concentration in the air at which lifting is to occur varies with the types of gas and hence a large variance is included in the safety operation. This has been blocking the practical use of the above system.

It has been recently proposed to use a combustion sensor which utilizes a principle of an oxygen concentration cell, in addition to the thermocouple, so that an e.m.f. of the sensor upon the incomplete combustion of the burner is fed with an inverse relation to that of the thermocouple to close the electromagnetic safety valve.

This system, however, requires the separate sensor in addition to the thermocouple resulting in the increase in cost. Furthermore, in case there occurs failure such as break of the fuel sensor, the electromagnetic safety valve is not blocked but the incomplete combustion is maintained even if the oxygen concentration in the air decreases.

The present invention is intended to overcome those problems encountered in the prior art, and it comprises a combustion sensor having porous electrodes disposed on both sides of a sintered body of ion conductive solid electrolyte with one of the electrodes being exposed to an exhaust gas atmosphere of the burner while the other electrode being exposed to a gas atmosphere other than the exhaust gas atmosphere, with an e.m.f. of the sensor changing with a ratio of oxygen concentrations of both gases and a resistance of the sensor changing with a temperature; an electromagnetic safety valve connected to a fully supply path to the burner; and an electric control circuit responsive to a change in the e.m.f. of the fuel sensor due to incomplete combustion of the burner and a change in the resistance of the sensor due to the extinction of the burner.

It is a first object of the present invention to provide a safety equipment for a gas burner wherein a single fuel sensor which has porous electrodes disposed on both sides of a sintered body of ion conductive solid electrolyte and operates under a principle of an oxygen concentration cell, is provided so that the incomplete combustion of the burner is detected by a change in an e.m.f. of the sensor while the extinction is detected by a change in a resistance for blocking a fuel gas supply path in order to prevent gas poisoning and explosion by the flow of gas.

It is a second object of the present invention to provide a safety equipment for a gas burner which works well independently of the type of gas.

It is a third object of the present invention to insure safety operation by opening the electromagnetic safety valve irrespective of the fuel sensor for a given time period during firing of the burner in order to prevent malfunction during firing of the burner.

The above and other objects, features and advantages of the invention will become more apparent from the following detailed description of the preferred embodiments of the invention when taken is conjunction with the accompanying drawings, in which.

Figure 1:
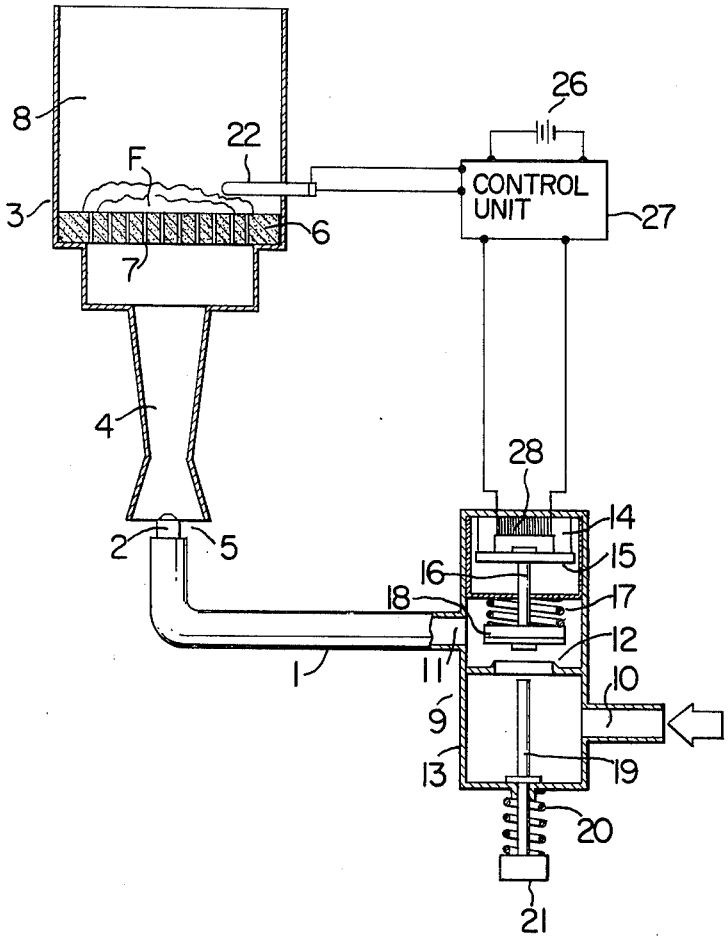
FIG. 1 shows a schematic view of a gas burner with a safety equipment.

Referring now to the drawings, the preferred embodiments of the safety equipment for gas burner in accordance with the present invention are explained in detail.

In FIG. 1, gas supplied through a gas supply path 1 to a nozzle 2 is ejected toward a mixing tube 4 of a gas burner 3. As the gas is ejected, all of the air required for the combustion of gas is taken in through an opening 5 at the end of the mixing tube 4. The gas and the air are fully mixed together in the mixing tube 4 and the gas mixture is ejected through flame apertures 7 formed in a combustion board 6 into a combustion chamber 8. By igniting the gas mixture by a suitable ignition means, a flame F is formed in contact with the flame aperture 7.

Numeral 9 denotes an electromagnetic safety valve connected intermediate the gas supply path 1, and it comprises a valve case 13 having a valve seat 12 between a gas inlet 10 and a gas outlet 11, an electromagnet 14, a valve body 18 which integrally couples a magnetic plate 15 facing the electromagnet 14 through a valve rod 16 and is biased by a spring 17 toward the valve seat 12, and an opening rod 19 for manually opening the valve body 18. Numeral 20 denotes a restoring spring for the opening rod 19 and 21 denotes a button. Numeral 22 denotes a combustion sensor projecting into a combustion area of the burner 3.

Figure 2:
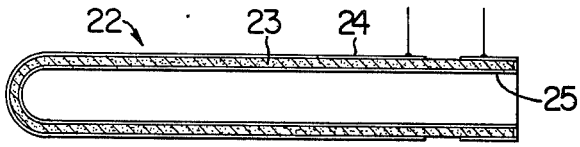
FIG. 2 shows a sectional view of a combustion sensor.

The combustion sensor 22 is a kind of oxygen concentration cell in which, as shown in FIG. 2, porous electrodes 24 and 25 of platinum are disposed on both sides of a sintered body 23 of ion conductive solid electrolyte, such as $ZrO_2$ or $ThO_2$ stabilized by CaO or $Y_2O_3$, of a cylinder shape with one end thereof being closed. The closed end of the sensor 22 projects into the combustion chamber 8 while the other open end is left open to a room atmosphere so that air freely flows into or out of the interior of the sensor.

Figure 3:
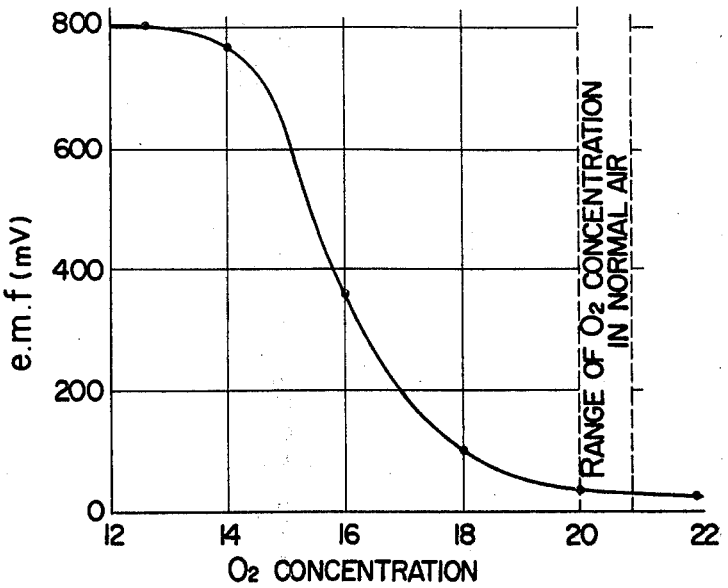
FIG. 3 shows a graph illustrating a relation between an oxygen concentration in a fuel-air mixture and an e.m.f. of the combustion sensor.
Figure 4:
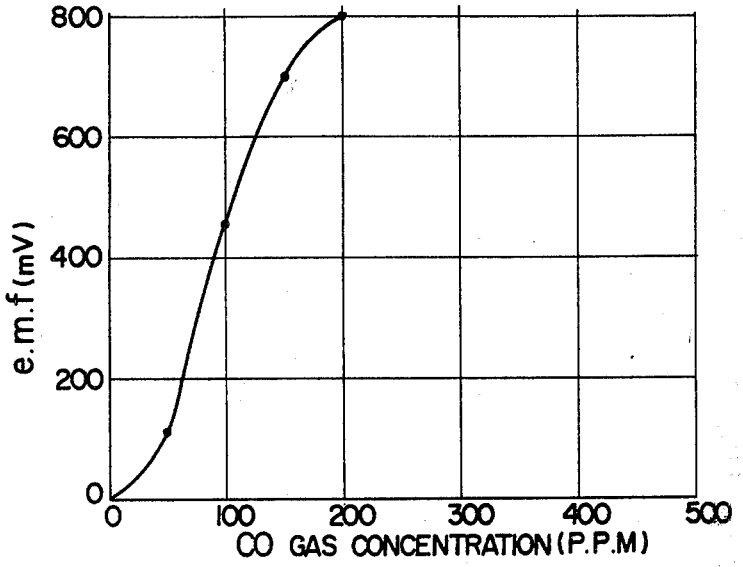
FIG. 4 shows a graph illustrating a relation between CO concentration and the e.m.f. of the combustion sensor.

Thus, when a difference in oxygen concentrations between outer exhaust gas and inner gas exceeds a predetermined level, the sensor 22 produces an e.m.f. FIG. 3 shows a relation between the oxygen concentration in the air and the e.m.f. of the sensor 22, and it is seen that when the oxygen concentration reduces below 18%, the e.m.f. abruptly increases to 800 mV at maximum. This increase of the e.m.f. is due to the fact that the amount of oxygen in the fuel-air mixture reduces to an extent to cause incomplete combustion of the gas burner 3, resulting in remarkable reduction in the oxygen concentration remaining in the exhaust gas to increase the ratio of oxygen concentrations of inner and outer atmospheres of the sensor 22.

The incomplete combustion of the burner 3 causes to increase the amount of CO gas in the exhaust gas and hence the change of the e.m.f. of the sensor 22 is also related to the CO gas concentration in the exhaust gas.

That is, the sensor 22 may be considered as a CO gas sensor.

Figure 5:
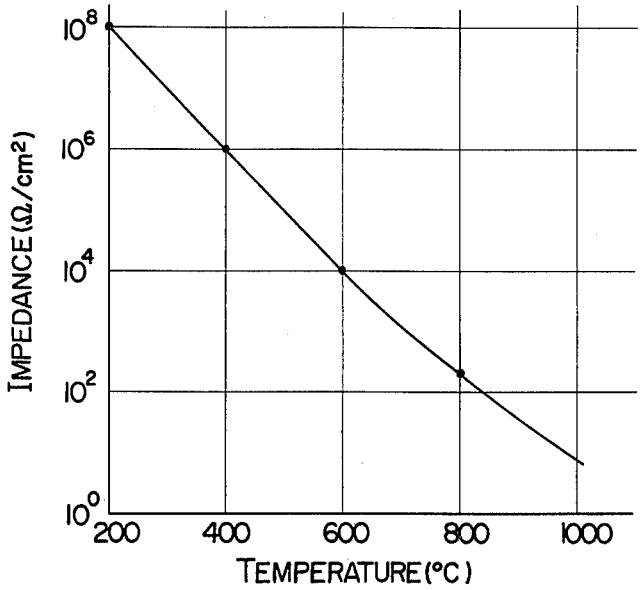
FIG. 5 shows a graph illustrating a relation between a temperature of the sensor and a resistance thereof.

Furthermore, as shown in FIG. 5, a resistance of the sensor 22 reduces as a temperature rises. During normal gas combustion, temperature rises up to 800°–850° C. At this time, the resistor of the sensor 22 is low, i.e. in the order of 100 $\Omega/cm^2$, and as the temperature drops by the extinction of the burner the resistance of the sensor 22 increases substantially, as shown in FIG. 5.

Turning back to FIG. 1, when the oxygen concentration in the air, is normal, the gas burner 3 is in complete combustion state and the e.m.f. as well as the resistance of the combustion sensor 22 are low. Accordingly, a control unit 27 which is powered by a battery 26 energize an exciting coil 28 of the electromagnet 14, which in turn attracts the magnet plate 15. As a result, the valve 18 is opened against the spring 17.

If the oxygen concentration in the air reduces with the result that the amount of CO gas in the exhaust gas increases, the control unit 27 interrupts the current to the exciting coil 28. Thus, the electromagnet 14 is deenergized and the magnetic coupling with the magnetic plate 15 disappears. As a result, the valve 18 closes the valve seat 12 by the action of the spring 17 so that further supply of gas to the gas burner is blocked.

When the gas burner 3 extinguishes, the control unit 27 also interrupts the energization to the exciting coil 28 by the increase of the resistance of the sensor 22, so that the supply of gas to the gas burner 3 is blocked.

As described above, according to the present invention, the single combustion sensor 22 can be used to detect the incomplete combustion of the gas burner 3 and the extinction of the gas burner 3 for blocking the supply of gas. Accordingly, the present invention is advantageous in cost aspect and assures safety operation independently of the type of gas.

Figure 6:
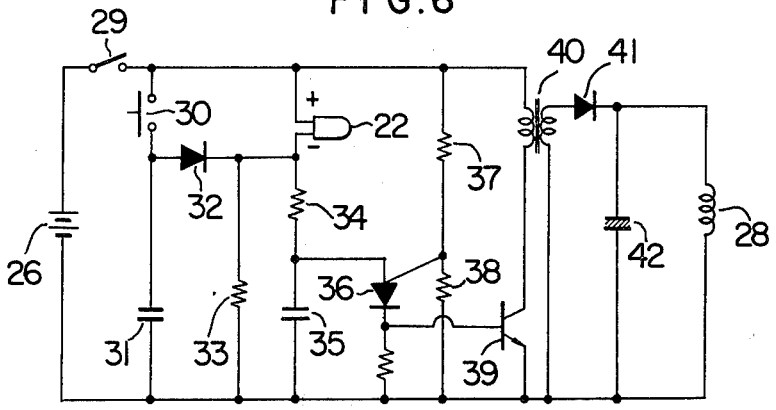
FIG. 6 shows a particular electrical circuit diagram of a control unit.

A specific embodiment of the control unit 27 is now explained with reference to FIG. 6. In FIG. 6, numeral 29 denotes a power switch, 30 denotes a switch linked to a button 21 and it is closed only when the button 21 is depressed. Numeral 26 denotes a battery. Once the switch 30 is closed, a first capacitor 31 is charged. The charge stored in the capacitor 31 is then slightly discharged through a diode 32 and a resistor 33. At the same time, a second capacitor having a smaller capacitance than that of the first capacitor 31 is charged through a resistor 34. As the second capacitor 35 is charged, an anode voltage of a PUT 36 exceeds a gate voltage which is determined by dividing resistors 37 and 38, so that the PUT 36 is turned on, which in turn, turns a transistor 39 on. When the PUT 36 is turned on, the second capacitor 35 is discharged through the PUT 36. As a result, the anode voltage of the PUT 36 goes below the gate voltage so that the PUT 36 is turned off and the second capacitor 35 is again charged by the first capacitor 31. In this manner, the transistor 39 continues to oscillate until the voltage across the first capacitor 31 reduces below a predetermined level. As the transistor 39 oscillates, a transformer 40 is excited to cause an exciting current to flow therethrough, which is rectified and filtered by a diode 41 and a capacitor 42 and flows into the electromagnet coil 28. As a result, the electromagnet 14 maintains the open state of the fuel path to allow the combustion to continue.

Since the resistance of the sensor 22 has been reduced by being heated by the combustion flame F by the time when the voltage across the first capacitor 31 reaches the predetermined level, that is, by the time preset by a timer, charging of the second capacitor 35 is effected through the sensor 22 so that the oscillation of the transistor 39 is maintained and the open state of the fuel path is maintained even after the across the capacitor 31 has decreased below the predetermined level.

If theccombustion flame F extinguishes by any reason, the resistance of the sensor 22 increases. As a result, the second capacitor 35 is not fully charged and hence the oscillation of the transistor 39 is stopped. Thus, the coil 28 is not energized so that the valve 9 is blocked to prevent ejection of fuel gas. When the amount of oxygen is too small, the sensor 22 produces the e.m.f. of approximately 800 mV. Thus, the anode voltage of the PUT 36 is lower than the gate voltage, and the oscillation is stopped and the fuel path is blocked. Accordingly, the single sensor can detect the presence or absence of the combustion flame and the oxygen depleted condition. This simplifies the construction of the safety equipment.

Furthermore, if the sensor 22 breaks or deteriorates, the transistor 39 does not oscillate because the second capacitor 35 is not properly charged through the sensor 22, and hence the fuel path is no longer maintained in its open state.

Figure 7:
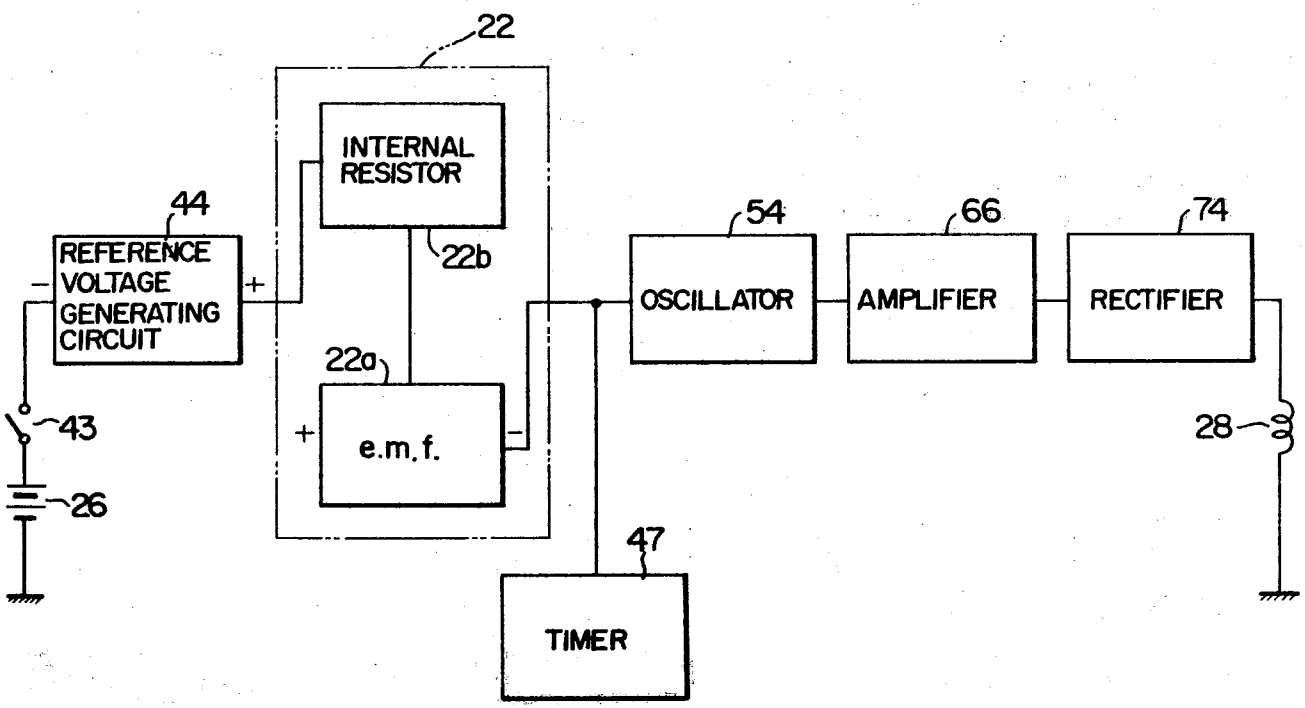
FIG. 7 shows a block diagram of another embodiment of the control unit.
Figure 8:
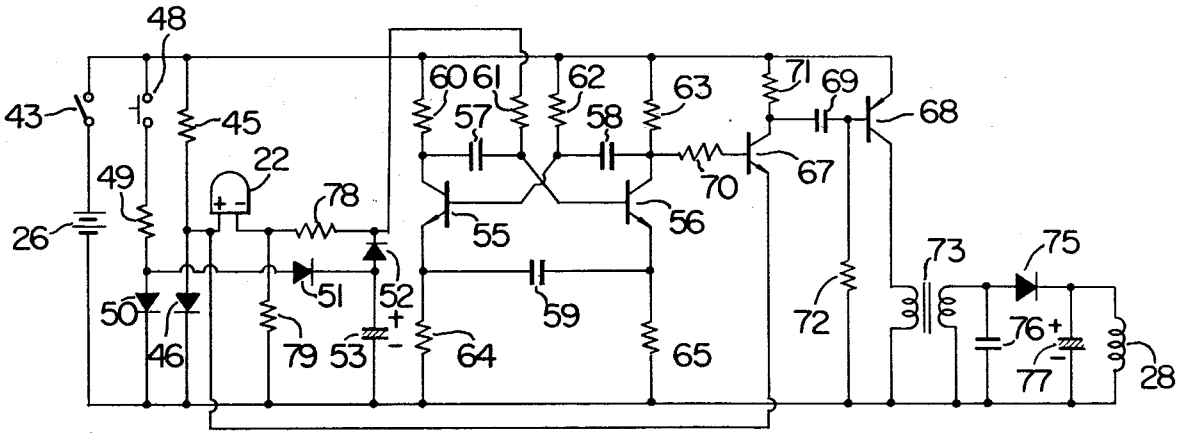
FIG. 8 shows an electrical circuit diagram thereof.

Another specific embodiment of the control unit is now explained in conjunction with FIGS. 7 and 8, in which numeral 26 denotes a D.C. battery power supply, 43 a power switch, 44 a reference voltage generating circuit which comprises a resistor 45 and a diode 46. Numeral 22 denotes a combustion sensor which has characteristics that an e.m.f. **22*a* at room temperature is near zero and an internal resistance 22*b* at room temperature is $10^8$ Ω or more and approximately 100 Ω at about 800° C, and an e.m.f. 22*a* during incomplete combustion is approximately 800 mV while an internal resistance 22*b* during incomplete combustion is approximately 100 Ω. The reference voltage generating circuit 44 serves to prevent the affect by the variation of the D.C. power supply 26 to stabilize the threshold of the e.m.f. 22*a*. Numeral 47 denotes a timer circuit which comprises a switch 48 which is momentarily closed with the movement of a push-button of an electromagnet safety valve, a resistor 49, diodes 50 to 52 and a capacitor 53. Numeral 54 denotes an oscillation circuit which oscillates only when an input voltage thereto is above a predetermined level, e.g. approximately 0.6 V. In the example of FIG. 8, the oscillator circuit 54 comprises transistors 55 and 56 forming an astable multivibrator, capacitors 57** to 59, and resistors 60 to 65. Numeral 66 denotes an amplifier circuit which amplifies an output power of the oscillation circuit 54 and comprises transistors 67, 68, a capacitor 69, resistors 70 to 72 and a transformer 73. Numeral 74 denotes a rectifying circuit which rectifies amplified output of the oscillation circuit 54 and comprises a diode 75 and capacitors 76 and 77. Numeral 28 denotes a coil of an electromagnet for a safety valve for controlling the supply of fuel. Numerals 78 and 79 denote resistors.

With the arrangement described above, when the safety valve is operated to supply fuel and the fuel is ignited, the switch 48 is closed and a current flows throughout the circuit. At the same time, the charge stored in the capacitor 53 by the timer circuit 47 is applied to the oscillation circuit 54, which starts to oscillate to cause a D.C. current to flow throw the coil 28. Assuming that a D.C. resistance of the coil 28 is 460 Ω and the number of turns is 2400, for example, when a current of 2 mA flows through the coil 24 an m.m.f. of 4.8 A-T is produced. Thus, by manually operating the safety valve momentarily during the ignition, through the capacitor 53 of the timer circuit 47, the subsequent operation is automatically carried out. When a predetermined time period, e.g., 60 seconds, has passed after the ignition, the voltage applied from the timer circuit 47 to the oscillator circuit 54 reduces below an oscillation persisting voltage of the oscillator circuit 54, e.g. 0.6 V so that the oscillation can not be maintained only by the output voltage of the timer circuit 47. However, since the internal resistance 22*b* of the sensor 22, which has been $10^8$ Ω or more immediately after the ignition, is reduced to 100 Ω after 30 seconds by the rise of temperature, the voltage applied to the oscillator circuit 54 from the D.C. power supply 26 through the reference voltage generating circuit 44 and the internal resistance 22*b* of the sensor 22 exceeds the oscillation persisting voltage of the oscillator circuit 54. Accordingly, after 30 seconds have elapsed, the oscillation can be maintained irrespective of the decrease of the output voltage of the timer circuit 47.

If the burner exitinguishes by any reason during its normal burning condition, the temperature of the sensor 22 decreases and the internal resistor of the sensor 22 increases from approximately 100 Ω to 10 and several KΩ in about 40 seconds from the extinction. As a result, the voltage applied from the reference voltage generating circuit 44 of the D.C. power supply 26 to the oscillator circuit 34 through the internal resistor 22*b* of the sensor 22 decreases below the oscillation persisting voltage of the oscillator circuit 54, e.g. 0.6 V, and the oscillation is stopped to close the safety valve. When incomplete combustion condition occurs during normal combustion condition by, for example, incomplete venting, the internal resistance 22*b* of the sensor 22 does not change substantially but the e.m.f. changes from approximately zero volt to approximately 800 mV. Since this e.m.f. is in opposite sense to the reference voltage of the reference voltage generating circuit 44 as shown in FIG. 7, the voltage supplied from the reference voltage generating circuit 44 to the oscillator circuit 54 through the sensor 22 decreases below the oscillation persisting voltage of the oscillator circuit 54. As a result, the oscillation is stopped and the safety valve is closed to block the feed of the fuel.

The control unit operates in the manner described above to block the feed of the fuel when incomplete combustion or extinction occurs for preventing gas poisoning and explosion. In the above embodiment, the oscillator circuit 54 is used to control the current flow through the coil 28 of the electromagnet of the safety valve when the applied voltage is above the predetermined voltage, e.g. 0.6 V, and the stages succeeding to the oscillator circuit 54 are A.C. coupled. As an alternative, a voltage comparator may be used as the control unit to determine whether the applied voltage is above the predetermined voltage and an output signal of the comparator is used to switch the current flowing through the coil 28. In this manner, the control unit may be implemented by a D.C. coupled system, which allows inexpensive construction of the unit because parts such as transformer can be eliminated.

As described hereinabove, the safety control unit shown in FIGS. 7 and 8 senses both incomplete combustion condition and extinction condition by the single sensor made of ion conductive solid electrolyte having a property of low internal resistance and a finite e.m.f. under the incomplete combustion condition and higher internal resistance under the extinction condition. Accordingly, the construction of the detection unit is simplified. Furthermore, since the coil of the electromagnet of the safety valve is energized at an early stage of ignition by the timer circuit which utilizes charge-discharge of the capacitor, the manual operation of the safety valve is momentarily carried out. Furthermore, since the control unit controls such that the current flows through the coil when the voltage exceeds the predetermined level, the current flowing through the coil will be zero under the incomplete combustion condition and the extinction condition. Accordingly, the safety valve can be positively operated irrespective of variations in the number of turns of the coil and the internal resistance of the sensor. Moreover, the variation of the supply voltage due to consumption of the battery can be compensated by the reference voltage generating circuit so that the unit does not operate erroneously by the consumption of the battery. Furthermore, since the sensor is connected in opposite sense to the reference voltage generating circuit, the threshold of the sensor output voltage can be readily changed by merely changing the reference voltage so that the safety valve may be closed even when the sensor fails.

Furthermore, since the oscillator circuit is used as the control circuit and the A.C. coupled system is used, a fail-safe feature is added because whenever any transistor constituting the circuit fails, the oscillation of the oscillator circuit stops. The output signal of the oscillator circuit may be sine wave or square wave. A square wave of fast rise and fall times is advantageous in reducing power loss of the transistors and improving life of the battery.

What is claimed is:

1. A safety equipment for a gas burner comprising:

a combustion sensor having porous electrodes disposed on both sides of a sintered body of ion conductive solid electrolyte, one of said electrodes being exposed to an exhaust gas atmosphere of the burner while the other electrode being exposed to a gas atmosphere other than said exhaust gas atmosphere, said sensor generating an e.m.f. depending on a ratio of oxygen concentrations of said gas atmospheres, a resistance of said sensor changing with a temperature;

an electromagnetic safety valve connected in a fuel supply path to said burner; and an electrical control circuit responsive to a change in the e.m.f. of said combustion sensor due to incomplete combustion of said burner and responsive to a change in the resistance of said sensor due to extinction of said burner, for controlling said electromagnetic safety valve.

2. A safety equipment for a gas burner according to claim 1 further including a timer circuit for allowing the application of an operation voltage to said electrical control circuit for a given time period upon the ignition of the burner.

3. A safety equipment for a gas burner according to claim 1 wherein a power supply voltage to said electrical control circuit is stabilized by a reference voltage generating circuit.

4. A safety equipment for a gas burner according to claim 1 wherein said electrical control circuit comprises a voltage comparator which, in turn, is used to switch current flowing through said electromagnetic safety switch.

5. A safety equipment for a gas burner according to claim 1 wherein said combustion sensor is of tubular shape, and the exhaust gas is fed to outer periphery of the tube while air is fed to inner periphery of the tube.

6. A safety equipment for a gas burner according to claim 5 wherein said combustion chamber is of tubular shape having its one end closed, said closed end being exposed to combustion region of the burner while the other open end being left open to atmosphere.

7. A safety equipment for a gas burner according to claim 6 wherein all of the air required to burn the fuel in the burner is taken in as primary air and the supply of air to separate system to combustion region is interrupted to make larger a ratio of oxygen concentrations of the electrodes in the combustion sensor.

* * * * *